US006381907B1

(12) United States Patent
MacKarvich

(10) Patent No.: US 6,381,907 B1
(45) Date of Patent: May 7, 2002

(54) ADJUSTABLE SUPPORT SYSTEM FOR PREMANUFACTURED BUILDING

(76) Inventor: Charles J. MacKarvich, 3940 Paces Manor Dr., Atlanta, GA (US) 30339

( * ) Notice: Subject to any disclaimer, the term of this patent is extended or adjusted under 35 U.S.C. 154(b) by 0 days.

(21) Appl. No.: 09/740,431

(22) Filed: Dec. 18, 2000

(51) Int. Cl.[7] ..... E02D 27/00

(52) U.S. Cl. ..... 52/126.6; 52/105; 52/126.1; 52/167.3; 52/292; 52/DIG. 11

(58) Field of Search ..... 52/105, 126.1, 52/126.5, 126.6, 146, DIG. 11, 127.7, 127.12, 167.3, 292, 299; 248/351, 352, 354.5, 354.6

(56) References Cited

U.S. PATENT DOCUMENTS

| | | | | | |
|---|---|---|---|---|---|
| 187,337 | A | | 2/1877 | Wing et al. | |
| 709,300 | A | | 9/1902 | Buchtel | |
| 3,599,380 | A | | 8/1971 | Menzi | |
| 3,747,951 | A | * | 7/1973 | Brown | 52/DIG. 11 X |
| 3,750,349 | A | | 8/1973 | Deike | |
| 3,751,866 | A | | 8/1973 | Renchen | |
| 3,830,024 | A | | 8/1974 | Warnke | |
| 3,845,597 | A | | 11/1974 | Foster | |
| 4,014,517 | A | * | 3/1977 | Keagle | 248/157 |
| 4,258,514 | A | | 3/1981 | St. Clair | |
| 4,261,149 | A | | 4/1981 | Gustafson | |
| 4,417,426 | A | | 11/1983 | Meng | |
| 4,562,673 | A | * | 1/1986 | Barari | 52/167.1 |
| 4,882,887 | A | * | 11/1989 | Giles et al. | 52/126.6 |
| 5,359,821 | A | | 11/1994 | Merriman | |
| 5,509,237 | A | * | 4/1996 | Coulter | 52/126.6 |
| 5,515,655 | A | * | 5/1996 | Hoffmann | 52/126.6 |
| 5,697,191 | A | | 12/1997 | MacKarvich | |
| 5,862,635 | A | * | 1/1999 | Linse et al. | 52/126.6 |
| 6,058,663 | A | | 5/2000 | MacKarvich | |
| 6,094,873 | A | * | 8/2000 | Hoffman et al. | 52/126.6 |
| 6,230,448 | B1 | * | 5/2001 | Oliver et al. | 52/DIG. 11 X |

* cited by examiner

*Primary Examiner*—Beth A. Stephan
*Assistant Examiner*—Brian E. Glessner
(74) *Attorney, Agent, or Firm*—Thomas, Kayden, Horstemeyer & Risley

(57) ABSTRACT

An adjustable support system is provided for a premanufactured building structure. Struts (65, 66) are mounted at their lower or platform ends in support clevises (45, 46), and are mounted to the joists (12, 13) of the building structure. The lower or platform end (78) of the struts can be moved horizontally with respect to the support platform (36) by rotating the adjustment nut (80) on the travel screw (55) of the support clevis. This effectively reorients the strut to a greater or smaller angle with respect to the horizontal, so that the strut bears more or less of the load of the joist and the building structure. Preferably, the rotation of the adjustment nut (80) is accomplished with a torque wrench which provides the installer with an indication of the load being assumed by the strut.

24 Claims, 8 Drawing Sheets

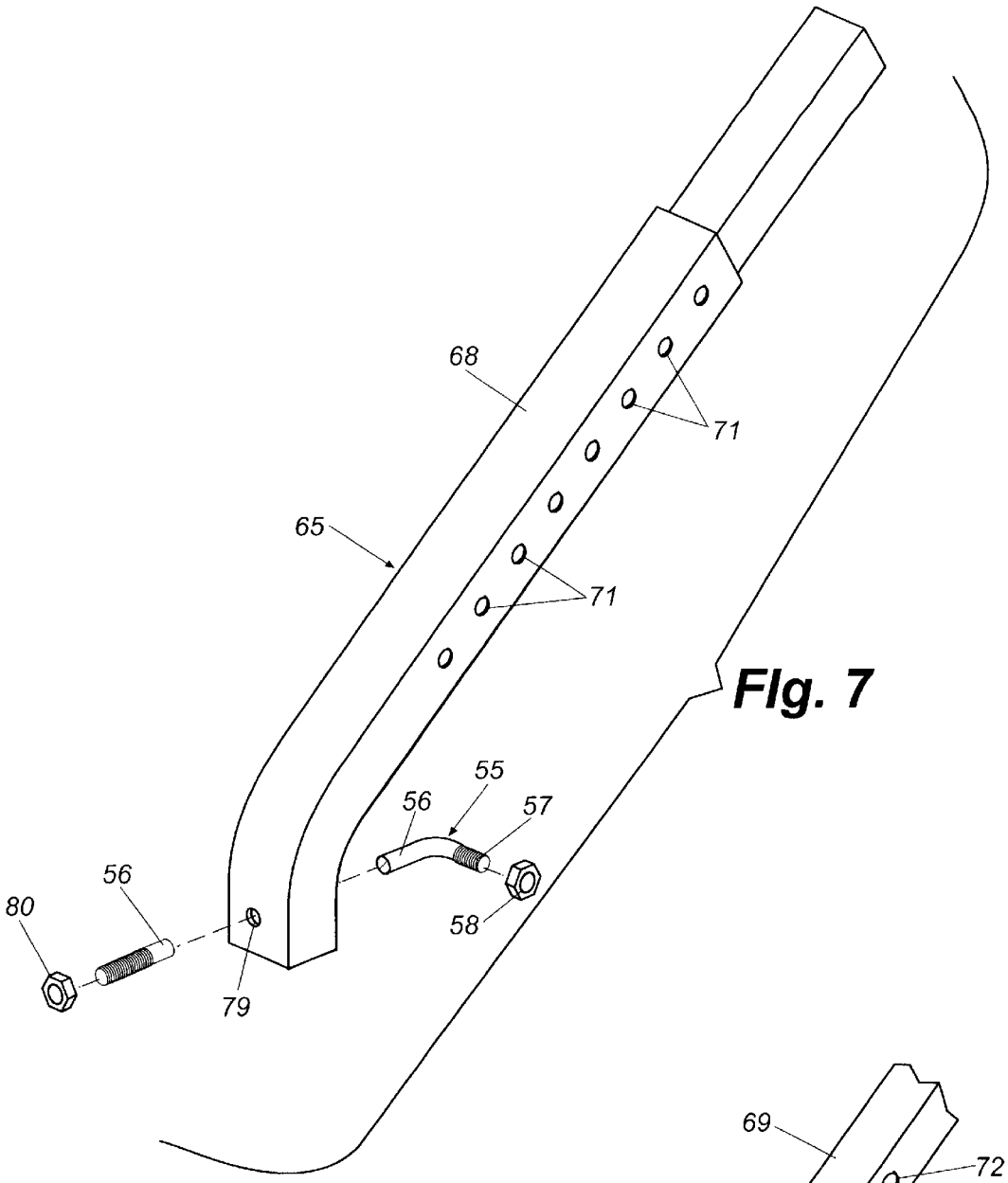
Flg. 7
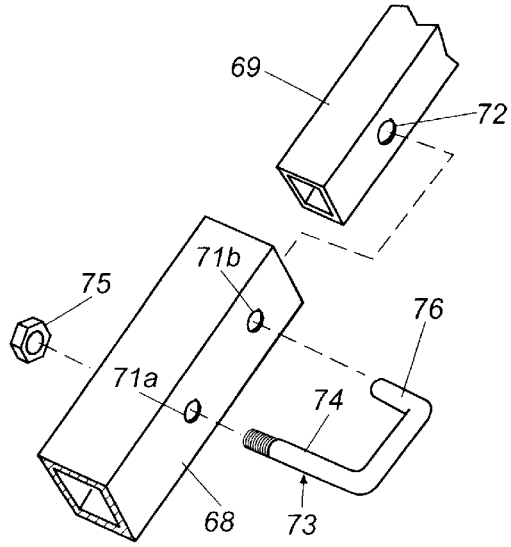
Fig. 8

ADJUSTABLE SUPPORT SYSTEM FOR PREMANUFACTURED BUILDING

FIELD OF THE INVENTION

This invention relates to a support system which adjustably supports the support joists of a premanufactured building when permanently installed at a building site. More particularly, the invention includes a support system that can be adjusted in height so as to bear more or less of the weight of the premanufactured building.

BACKGROUND OF THE INVENTION

Premanufactured buildings usually are constructed at a central location and transported to a permanent erection site. The typical premanufactured building structure includes a pair of parallel horizontal I-beam joists, with the building structure mounted on top of the joists. The joists typically are placed inwardly of the side edges of the building structure. When the building has been constructed, wheels are temporarily mounted to the joists so that the structure can be towed to the permanent erection site.

When the premanufactured building arrives at the erection site, the usual procedure for erecting the building is to prepare concrete support platforms in the ground, and to mount static piers on the platforms. The static piers are adjusted for proper height, and the building structure is then lowered onto the piers. Wedges, shims, or other fine adjustment devices can be urged between the piers and the joists so as to attempt to have all of the piers support approximately the same proportional load of the building structure.

The adjustment of the amount of support provided by each pier is a difficult task in that it usually is unknown as to how much weight each pier supports. For example, the ideal weight for a premanufactured building to apply to a pier might be 2000 lbs. However, visual observation of the building structure and the pier will not reveal the load applied by the building to each pier. If one pier supports a smaller load than the next adjacent pier, there is a likelihood that there will be some settling of the building structure downwardly on the pier that supports the larger load.

In the past, when a premanufactured building has experienced some settling after it has been mounted on piers, it is possible for the settling to be detected and remedied by placing wedges or shims between the piers and the joists where needed. However, even when the settling has been detected and remedied, it is not likely that the piers will each support approximately equal amounts of the load from the building structure, and additional settling of the building structure might occur.

It is to be foregoing problem that the invention disclosed herein is directed.

SUMMARY OF THE INVENTION

Briefly described, the present invention comprises an adjustable support system for a premanufactured building structure that includes adjustable piers that can be placed beneath the joists of the building structure. The adjustable piers can be adjusted vertically so as to assume more or less of the load of the joist and the weight of the building that is supported by the joist.

Typically, the premanufactured building structure will have been mounted on a plurality of static piers (as opposed to adjustable piers), with the static piers having been previously adjusted for height and therefore adjusted for bearing the load to be applied thereto by the building structure.

Once the building has been mounted on the static piers, the adjustable piers are placed on the ground beneath the joists and between the static piers at the preferred locations along the lengths of the joists. The adjustable piers are adjusted upwardly as may be necessary so as to assume a predetermined load from the joists of the building structure.

Although the adjustable piers can be placed at any location along the lengths of the joists, the preferred locations are at the ends of the joists, and therefore at the ends of the building structure, and at an intermediate position along the lengths of the joists and the intermediate portion of the building structure. The placement of the adjustable piers at the ends of the joists provides an ideal support arrangement at a critical part of the building structure. For example, if support provided by a static pier at the end of the structure is insufficient, the end of the building structure may settle, sag or sway. However, if an adjustable pier is provided at this location, the installer or the occupant of the building structure can adjust the load supported by the adjustable pier, thereby eliminating the settlement, sag, sway, or other symptom of insufficient support.

More particularly, the adjustable piers each include a support platform, preferably formed of sheet metal, that includes cleats at its edges that engage the ground on which the support platform is placed so that the support platform is not movable horizontally. Typically, a pair of struts are oriented at sloped angles extending between the support platform and the joist to be supported. A joist connector connects the upper or joist end of each strut to the joist, and the lower or platform end of each strut is mounted to the support platform. One of the ends of the strut, usually the platform end, is movably supported so that the angle of the slope of the strut can be changed, thereby changing the vertical height of the strut.

In a preferred embodiment of the invention, the lower or platform end of each strut is received in a clevis that is rigidly mounted to the support platform, and a travel screw is mounted in the clevis, with the lower or platform end of the strut being mounted to the travel screw. An adjustment nut is mounted to the travel screw in engagement with the lower end of the strut. Upon rotating the nut on the travel screw, the lower end of the strut moves horizontally with respect to the support platform while the upper end of the strut, being connected to the joist of the building does not move horizontally but simply rotates about its connection to the joist. This tends to adjust the angle of the slope of the strut. This effectively causes the upper end of the strut to increase or decrease its vertical displacement with respect to the lower end of the strut, thereby increasing or decreasing the load from the joist borne by the strut.

Usually a pair of struts will be used in each adjustable pier. Preferably, the struts of each pair of struts are sloped in opposed directions so that the horizontal forces applied through the struts cancel each other. For example, the pair of struts can be formed in an "X" configuration, in a "V" configuration, or in an inverted "V" configuration.

Typically, a torque wrench will be used to rotate the nut on the travel screw, so as to determine the load borne by the strut. For example, the application of a predetermined torque to the nut results in the strut bearing a predetermined vertical load at a prescribed angle of the strut.

Also, indicia is applied to the sidewalls of the clevis that receives the lower end of each strut to indicate the angle at which the strut extends upwardly from the support platform toward the support joist of the building structure. For example, the installer will be instructed to attempt to achieve an angle of between 40–50° between the strut and horizontal, with the preferred angle being 45°. This range of angles typically provides adequate vertical support for the building structure and also applies resistance to longitudinal movement of the joist in response to wind loads or seismic movement applied to the building structure.

Thus, it is an object of this invention to provide an infinitely adjustable support system for a premanufactured building structure that is expedient to install and which can be adjusted to support a prescribed load of the building structure.

Another object of this invention is to provide an improved adjustable pier which functions as an adjustable support system for a premanufactured building structure, with the support system having the ability to balance the load applied by the building structure to a multiple number of adjustable and static piers.

Other objects, features, and advantages of the present invention will become apparent upon reading the following specification, when taken in conjunction with the accompanying drawings.

BRIEF DESCRIPTION OF THE DRAWINGS

FIG. 7 is a perspective illustration of a strut.

FIG. 8 is a perspective illustration of an adjustable length strut having telescopic sections and a fastener used to hold the sections together.

DETAILED DESCRIPTION OF THE INVENTION

Figure 1:
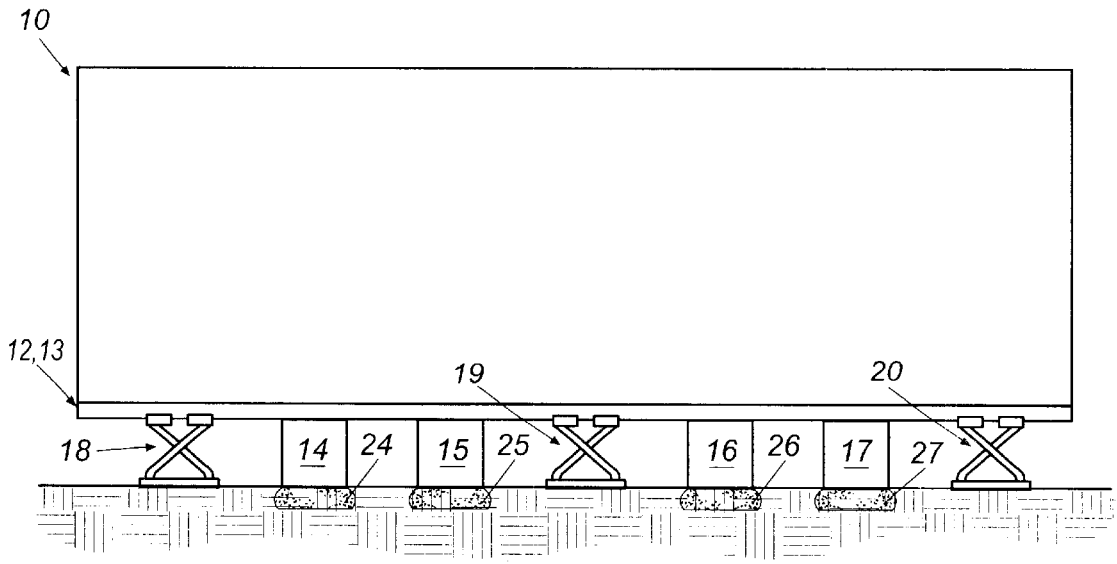
FIG. 1 is a schematic side view of a premanufactured building structure, showing adjustable piers at opposite ends of the building structure and intermediate the ends of the building structure, and static piers between the adjustable piers.

Referring in more detail to the drawings, in which like numerals indicate like parts throughout the several views, FIG. 1 illustrates a premanufactured building 10 which includes as a lower support framework a pair of parallel, horizontally extending rectilinear support beams or joists 12 and 13. The joists are supported on piers, such as static piers 14, 15, 16 and 17 that support joist 13, and duplicate static piers (not shown) that are in alignment with piers 14–17 and that support joist 12. In addition, adjustable piers 18, 19 and 20 are used to support the joist 13, with similar adjustable piers (not shown) in alignment with adjustable piers 18–20 for supporting joist 12.

The static piers 14–17 are of conventional construction, usually comprising concrete blocks mounted on poured concrete pads 24–27, respectively. The static piers are adjusted in height with the use of shims, wedges, etc. so as to have their upper surfaces placed in a common plane.

Typically, the concrete pads will be poured ahead of time in anticipation of the building structure 10 being placed over the pads. The building structure will be towed to the erection site and lowered onto static piers 14–17, with any necessary adjustment being made to the piers.

Once the building structure 10 has been lowered onto the static piers, the adjustable piers 18–20 for joist 13 and duplicate adjustable piers for joist 12 will be placed on the ground beneath the joists and adjusted so as to assume a share of the load of the building structure 10.

Figure 2:
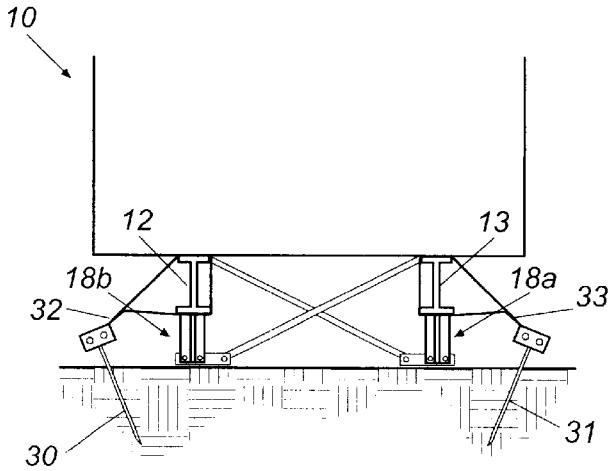
FIG. 2 shows an end view of the premanufactured building structure of FIG. 1, showing tie down straps and ground anchors used to hold the building structure to the ground, and the use of lateral struts in combination with the adjustable support system.

FIG. 2 shows adjustable piers 18A and 18B at an end of the building structure.

Once the static and adjustable piers have been placed in load receiving relationship beneath the building structure 10, ground anchors, such as the ground anchors 30 and 31 of FIG. 2, are driven into the ground adjacent the lower side edges of the building structure and adjacent the joists 12 and 13. Tension straps 32 and 33 have an end thereof formed into a loop that extends about the joists 12 or 13, with the other end of the tension strap is connected in the conventional manner to the head of the ground anchor. Several ground anchors and their tension straps will be applied to each joist 12 and 13 at intervals along the lengths of the joists so as to assure that the joists, and therefore the entire building structure, will be stabilized on the piers.

Figure 3:
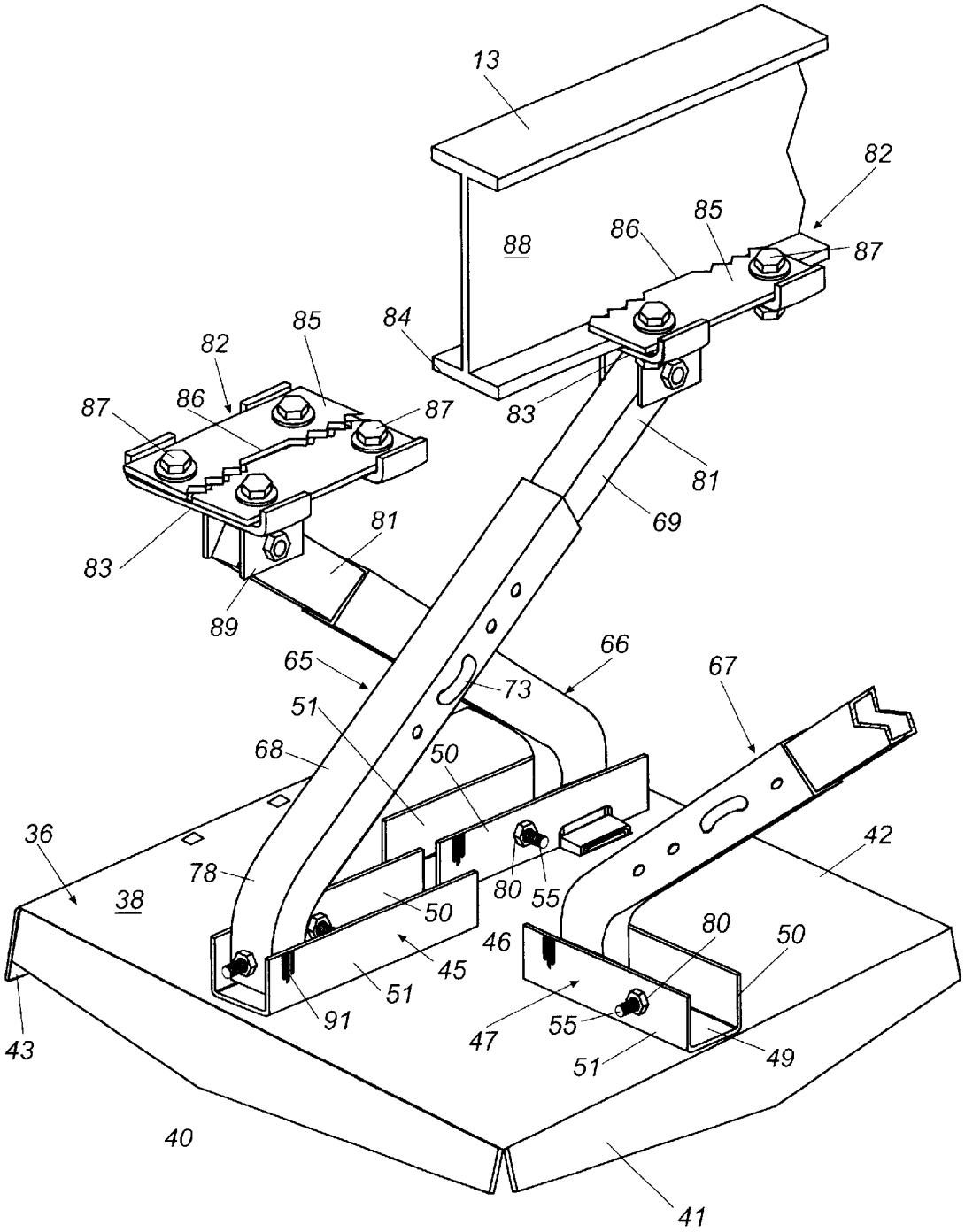
FIG. 3 is a perspective illustration of an adjustable support system for a premanufactured building, showing the struts oriented in the "X" shaped configuration and adjustably supported at their lower ends in support clevises.

As illustrated in FIG. 3, the adjustable pier or support system, such as adjustable pier 18A, includes a support platform 36 typically constructed of sheet metal, such as steel, having a flat body portion 38 and side cleats 40, 41, 42 and 43 at the edges of the support platform. The cleats 40–43 extend approximately normal to the flat body portion 38, and the cleats penetrate the ground beneath the support platform to provide lateral and longitudinal stability for the support platform.

Support devises 45, 46 and 47 are mounted on the upper surface of the body portion 38 of the support platform 36. The support devises typically are duplicates of one another, and each includes a U-shaped body having a base wall 49 and opposed parallel upright sidewalls 50 and 51. The devises are open at opposed ends and open along the portions thereof facing away from the body portion 38 of the support platform. One of the sidewalls 50 of each clevis defines an opening 54 for receiving one end of an L-shaped travel screw 55. The travel screw includes a threaded travel segment 56 and a threaded support segment 57, with the segments 56 and 57 forming a right angle. The threaded support segment 57 is inserted through the support opening 54 and is fastened to the sidewall 50 by means of a threaded nut 58. The threaded travel segment 56 extends parallel to and centrally of the space between the sidewalls 50 and 51 of the clevis.

A mounting tongue 60 is struck from sidewall 50 and base wall 49 of each clevis with the mounting tongue extending parallel to and in the same plane as base wall 49.

Mounting bracket 61 is struck from the flat body portion 38 of the support platform 36, defining a slot 62 which is sized and shaped to receive mounting tongue 60 of clevis 45. The mounting tongue 60 is telescopically moved through the slot 62 of the mounting bracket 61 so as to securely mount the clevis on the support platform 36, with the base wall 49 of the clevis in flat, frictional engagement with upper surface of the body portion 38 of the platform 36.

Figure 6:
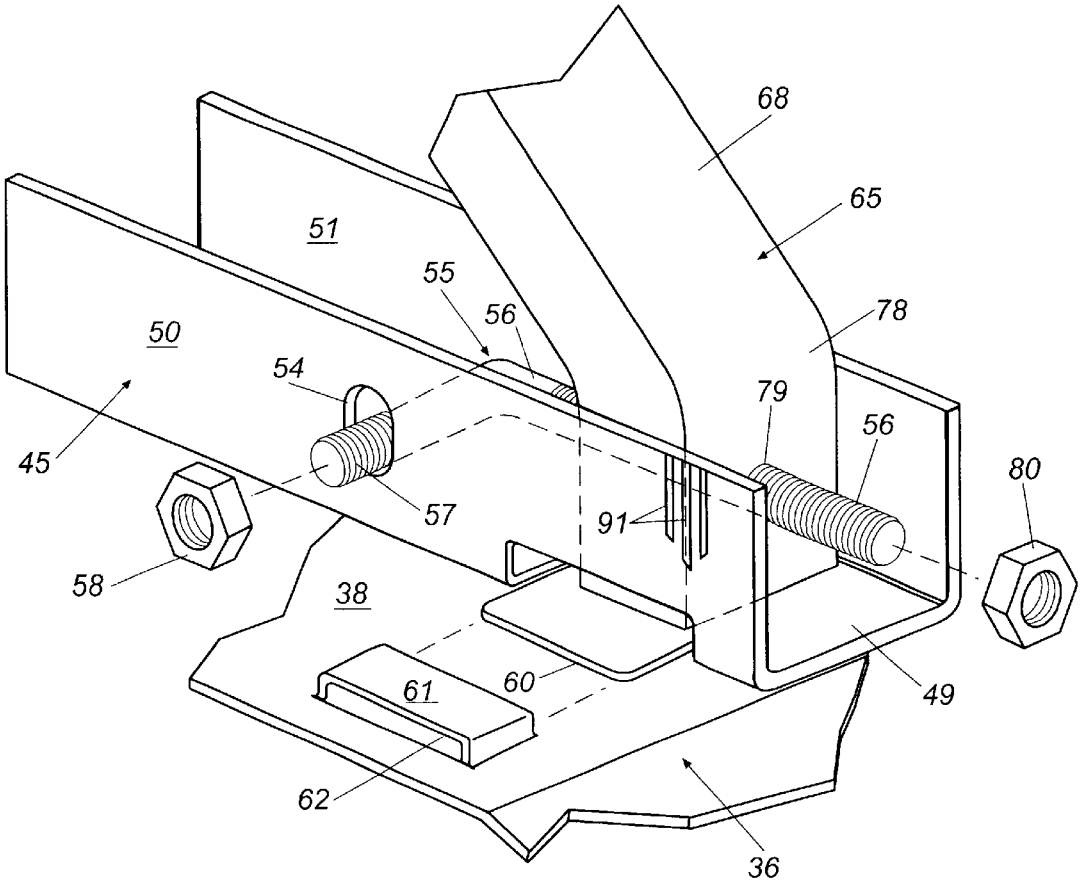
FIG. 6 is a perspective illustration of a support clevis, showing how a lower or platform end of a strut is received in the clevis and the travel screw is used to adjust the position of the lower end of the strut along the length of the travel screw.

As illustrated in FIGS. 3 and 6, struts 65, 66 and 67 are mounted in the support devises 45, 46 and 47, respectively. The struts can be of single piece construction or of two-piece, telescopic construction, as illustrated in the drawings. Strut 65 includes an outer, lower telescopic leg 68 and an inner, upper, telescopic leg 69, with leg 69 being slidably telescopically received in leg 68.

As shown in FIGS. 7 and 8, lower leg 68 of adjustable strut 65 includes a series of equally spaced openings 71 extending through the opposed sidewalls thereof, while the upper, inner leg 69 of the strut includes a similarly sized and shaped opening 72 at its lower end. When the upper leg 69 of the strut is telescopically inserted through the lower leg 68, a J-shaped lock pin 73 is used to lock the ends together. The lock pin has its long leg 74 inserted through one of the openings 71, such as opening 71A of FIG. 8, with the leg 74 of the lock pin abutting the end of the inner leg 69 of the strut, and with nut 75 threaded onto the threads at the distal end of the leg 74. In the meantime, the opening 72 of the upper leg 69 will register with the opening 71B of the lower leg 68, and the short leg 76 of the J-shaped lock pin 73 will register with opening 71B and opening 72. This locks the telescopic legs together, with the compression forces applied to opposed ends of the telescopic strut assembly, causing the inner leg 69 to bear against both the long leg 74 and short leg 76 of the J-shaped lock pin.

The lower, platform end 78 of the strut 65 is curved (FIG. 7), so that when in use, the lower platform end 78 extends approximately vertically with respect to the body portion 38 of the support platform 36, while the remaining portion of the strut extends at an angle, preferably about 45°, with respect to the body portion 38. However, the strut can be rectilinear along its full length, if desired.

The lower platform end 78 of the strut 65 includes a travel screw opening 79 therethrough, which loosely fits about the threaded travel segment 56 of the travel screw 55. Adjustment nut 80 is threaded on the threaded travel segment 56 of the travel screw behind strut 65. With this arrangement, the rotation of the adjustment nut 80 determines the position of the lower platform end 78 of the strut along the length of the travel screw 55 and the angle of the strut with respect to horizontal. The lower or platform end of the strut moves in an arc with respect to the joist.

Figure 4:
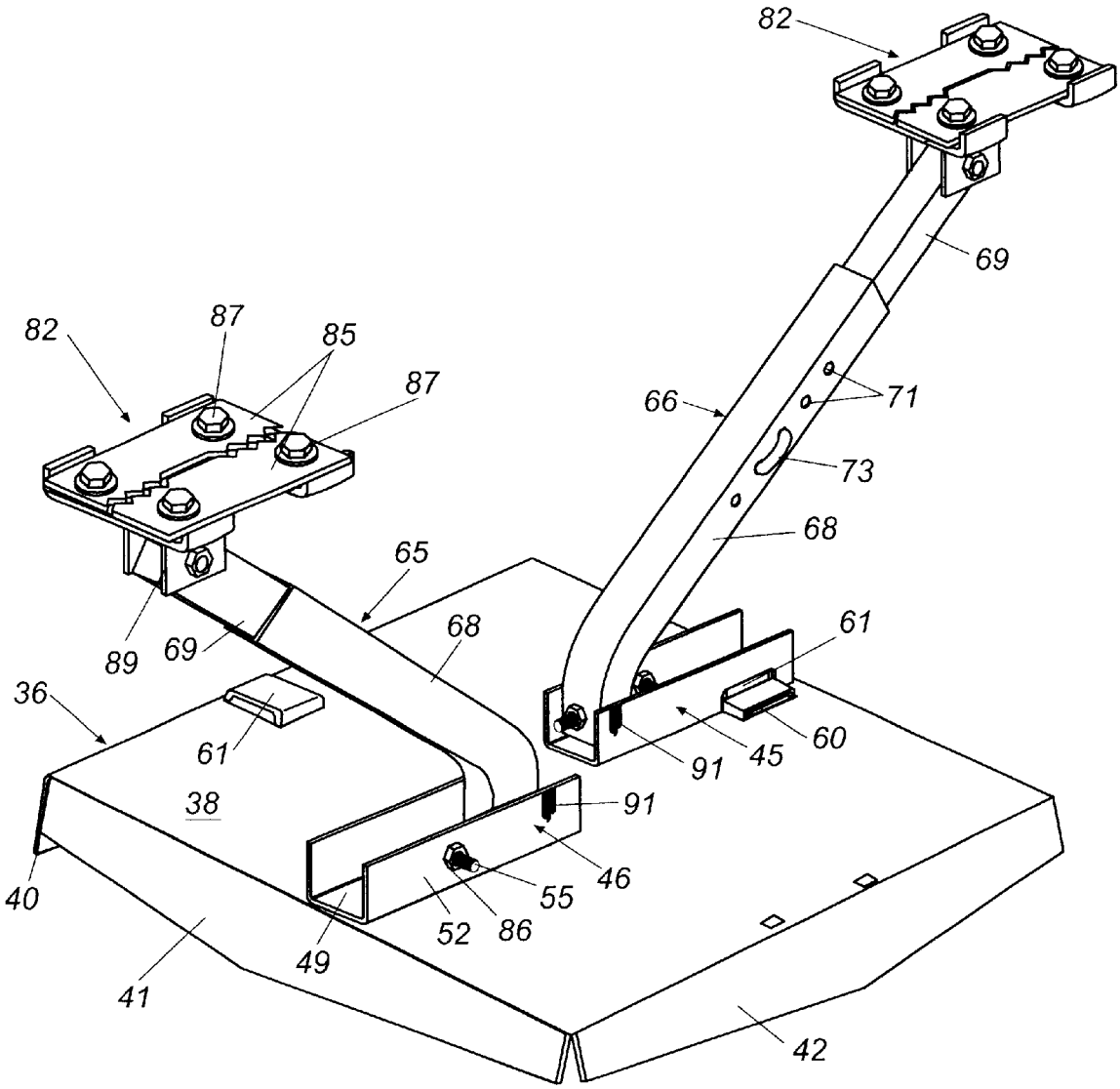
FIG. 4 is a perspective illustration of an adjustable support system, similar to FIG. 3, but showing the struts in a "V" shaped configuration.
Figure 5:
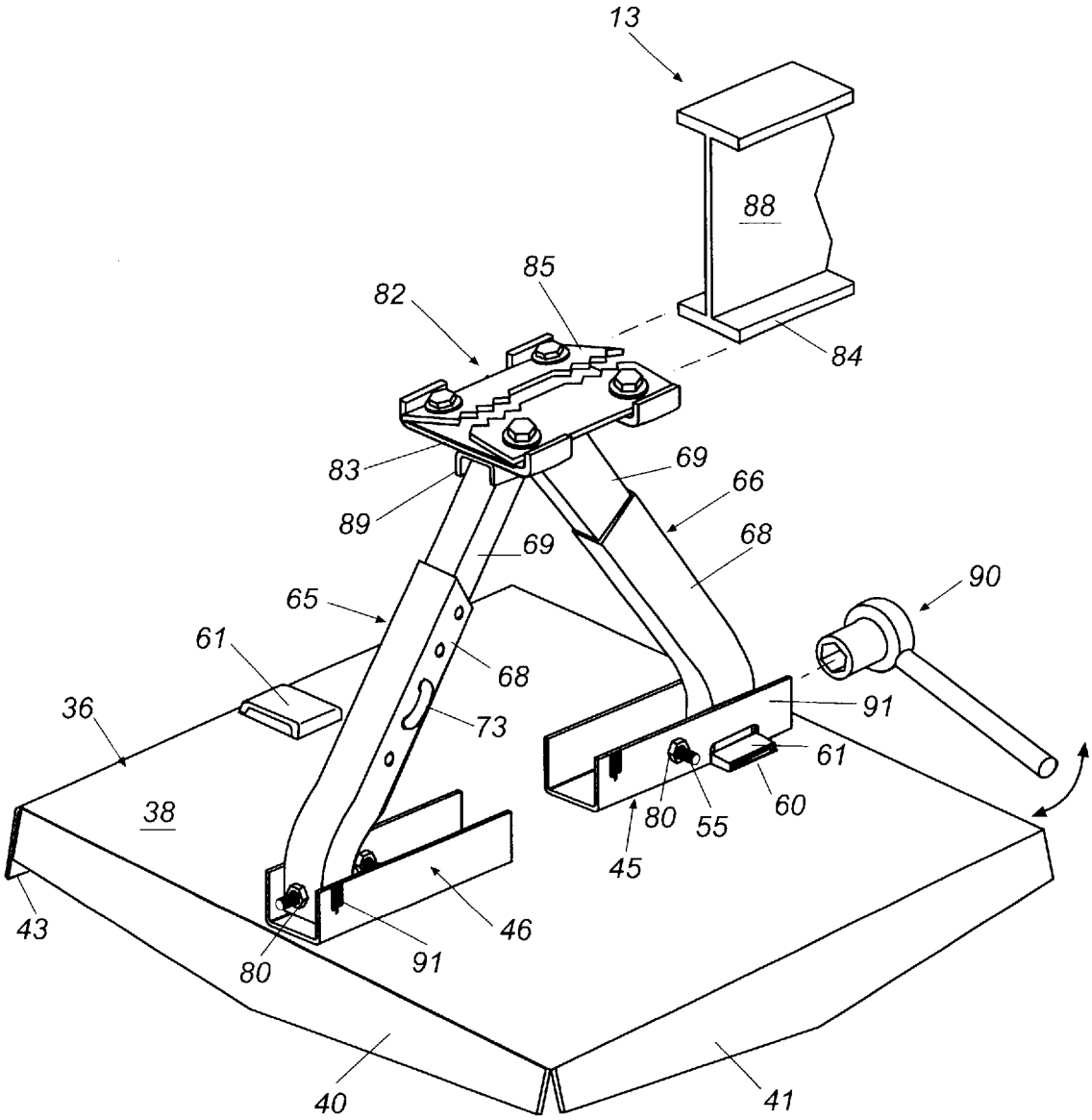
FIG. 5 is a perspective illustration of an adjustable support system, similar to FIGS. 3 and 4, but showing the struts in an inverted "V" shaped configuration.

As illustrated in FIGS. 3, 4 and 5, the struts can be arranged in different configurations with respect to the support platform 36. For example, FIG. 3 shows the struts 65 and 66 arranged in an "X" shaped configuration, FIG. 4 shows the struts arranged in a "V" shaped configuration, and FIG. 5 shows the struts arranged in an inverted "V" shaped configuration.

As shown in FIG. 3, the upper or joist ends of the struts 81 are mounted to joist connectors 82. The joist connectors each include a mounting plate 83 that is to rest against the bottom surface of the I-beam support plate 84 and a pair of clamp plates 85 attached to the edges of the I-beam support plate 84 by bolts 87. Serrated edges 86 of the clamp plates 85 extend over the I-beam support plate 84 into engagement with the central web 88 of the I-beam.

A clevis 89 is rigidly mounted to the bottom surface of the mounting plate 83 of each joist connector 82, with the clevis being pivotally connected by means of a bolt to the upper joist end 81 of the struts 65 and 66. Thus, the joist connectors 82 are firmly connected to the I-beam 13, with the upper joist ends of the struts 65 and 66 being pivotable with respect to the joist.

With this arrangement, the adjustable support piers 18–20 (FIG. 1) can be positioned beneath the premanufactured building structure 10 after the building structure has come to rest on the static piers 14–17, and the adjustable piers can be adjusted so as to take the positions illustrated in FIGS. 1–3. Typically, the support platform 36 will be placed on the ground surface and urged downwardly so that its cleats 40–43 penetrate the ground and stabilize the support platform, keeping it from being movable horizontally. Usually, the struts 65 and 66 will have been connected to the travel screws as illustrated in FIGS. 3–6 before the support platform is positioned beneath the joist of the building structure.

Once the support platform has been installed in its proper position, the joist connectors 82 will be clamped about the lower support plate 84 of the joist, such as joist 13 (FIG. 3), by placing the mounting plate 83 in contact with the bottom surface of the I-beam support plate 84, and then bolting the clamp plates 85 over the I-beam support plate 84 and in straddling relationship with the central web 88 of the I-beam. This loosely connects the telescopic segments of the struts between the support platform 36 and the I-beam 13.

The installer inserts the J-shaped lock pin 73 (FIG. 8) into the openings 71A and 71B of the outer leg 68 of the strut, with the short leg 76 extending through an opening 72 of the inner leg 69 of the telescopic strut. This holds the segments of the strut together. This can be done either before or after the joist connectors have been mounted to the joist.

The installer then uses a torque wrench 90 of conventional construction (FIG. 5) to tighten the adjustment nuts 80 of the travel screws 55. As the adjustment nut 80 of each travel screw 55 is threaded farther onto the threaded travel segment 56, the lower platform end 78 of the strut will move horizontally across the upper surface of the body portion 38 of the support platform 36, parallel to the joist 13, causing the strut to assume a more upright attitude. This tends to extend the vertical dimension of the strut and apply more compression to the strut, causing the strut to bear more of the load of the premanufactured building structure 10.

At least one sidewall 50 or 51 of the support devises 45 will include indicia 91 adjacent the strut mounted in the clevis. The indicia are carefully placed so as to indicate the angle assumed by the strut when mounted in a support clevis 45 or 46. Typically, the preferred angle for assuming the desired load and also for providing resistance to longitudinal movement of the joist is 45°. Accordingly, the indicia 91 include indication of a 45° attitude of the body portion of the strut when the vertical portion of the strut is aligned with the central indicia. Additional side indicia can be used to indicate an acceptable range of angles which are slightly off of the desired 45° angle.

Since the adjustment nut 80 is moved by a torque wrench 90 (FIG. 5), the torque wrench can determine the force required to rotate the adjustment nut. A reading of the torque wrench and a comparison of the reading of the torque wrench with the angle of the strut being adjusted provide an indication of the load being assumed by the strut. Therefore, the installer will not have to guess the proper degree of tightening of the adjustment nut, but can rely upon the readings of the torque wrench to provide an indication of the load being assumed by the strut.

FIG. 4 illustrates another configuration of the adjustable support system, or adjustable pier, whereby the struts are arranged in a "V" shaped configuration. The lower, platform ends of the struts are movable in the clevises, as described in more detail with respect to FIGS. 3, 6 and 7.

FIG. 5 illustrates yet another embodiment of the invention, whereby the adjustable struts are placed in an inverted "V" shaped configuration. The features of this embodiment are similar to those of FIGS. 3 and 4 but have the advantage of being able to utilize only a single joist connector 82.

As illustrated in FIGS. 1 and 3, a laterally extending sloped strut 67 can be mounted to the support platform 36 by means of a clevis 47 that is similar to devises 45 and 46. In this instance, the strut 67 is likely to be longer than the struts 65 and 66, and will extend at a smaller angle with respect to the horizontal over to the adjacent I-beam joist 12. This is illustrated in FIG. 2.

While the adjustable support systems of FIGS. 3–5 are utilized principally for adjustable support purposes, it will be noted that the sloped struts 65 and 66 also resist longitudinal movement of the joists 12 and 13 of the building structure. If a longitudinal force is applied to the building, the joists 12 and 13 tend to move longitudinally, but the sloped angle of the struts will apply the longitudinal force from the joist to the support platform 36. The cleats 40–43 of the support platform penetrate the ground, and the cleats that are oriented normal to the struts cause the longitudinal force from the joist to be applied through the struts, through the cleats and to the ground. The cleats avoid movement of the support platform 36 along the surface of the ground, so that the cleats, the support platform, and the sloped struts retard longitudinal movement of the joists, and therefore longitudinal movement of the building structure.

Likewise, the upper end of the laterally extending strut 67 (FIG. 3) retards lateral movement of the joist, by the lateral force applied by the joist to the strut being absorbed by the cleats of the support platform that are oriented normal to the joist.

FIGS. 9–12 show an alternate embodiment of the invention, whereby a modified support clevis 94 is used to support the lower end 95 of a rectilinear strut. The strut includes at its lower end a travel screw slot 96 in its wall 97 that faces downwardly. Opposed side walls 98 and 99 define aligned openings 100 (only one shown) for receiving laterally extending support screw 102.

Travel screw 104 includes a rectilinear end 105 and hook-shaped end 106. The hook-shaped end 106 is moved through the travel screw slot 96 and engages about a portion of the support screw 102 that extends inside the rectilinear strut 95. The other, rectilinear end 105 protrudes through the travel screw slot 96 and through an opening 108 in an end wall 109 at an end of the support clevis 94. The travel screw 104 is externally threaded, and an internally threaded position nut 110 is threaded onto the protruding end of the travel screw. When the position nut 110 is tightened, it draws the travel screw 104 toward the end wall 109, causing the lower end 95 of the rectilinear strut to move horizontally toward the end wall 109 of the support clevis 94. If the upper end of the support strut is prevented from moving laterally and is pivotally connected to the joist of the building structure, the horizontal movement of the lower end of the strut effectively increases the vertical displacement between the ends of the strut, thereby causing the strut to bear a larger weight of the joist of the building.

Figure 9:
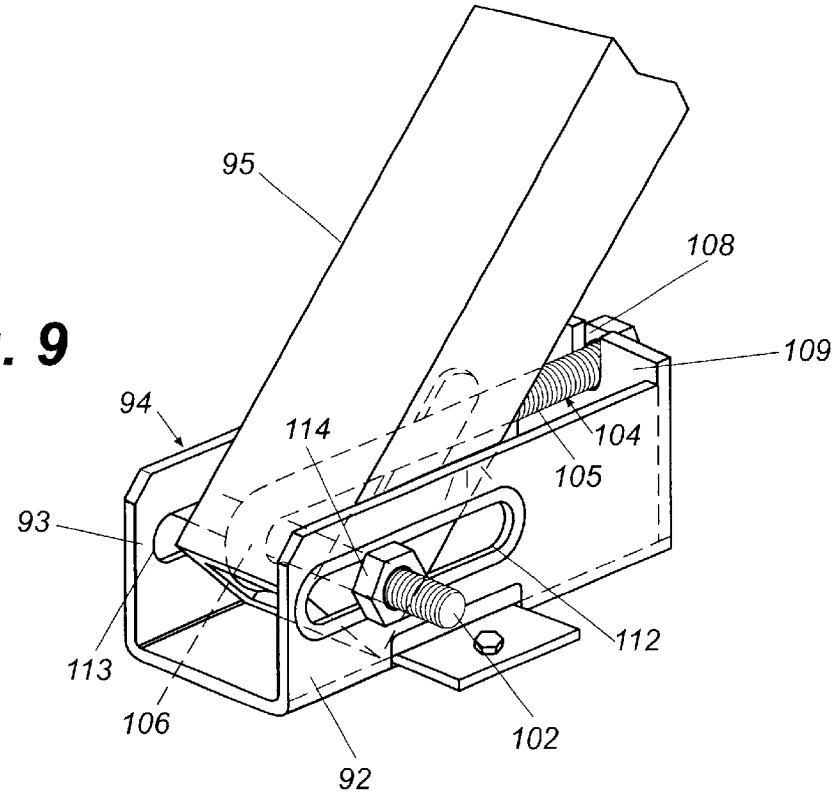
FIG. 9 is a perspective illustration of a modified support clevis that is usable as a substitute for the devises of FIGS. 3–6, and that is usable with struts that are rectilinear at their lower ends.
Figure 10:
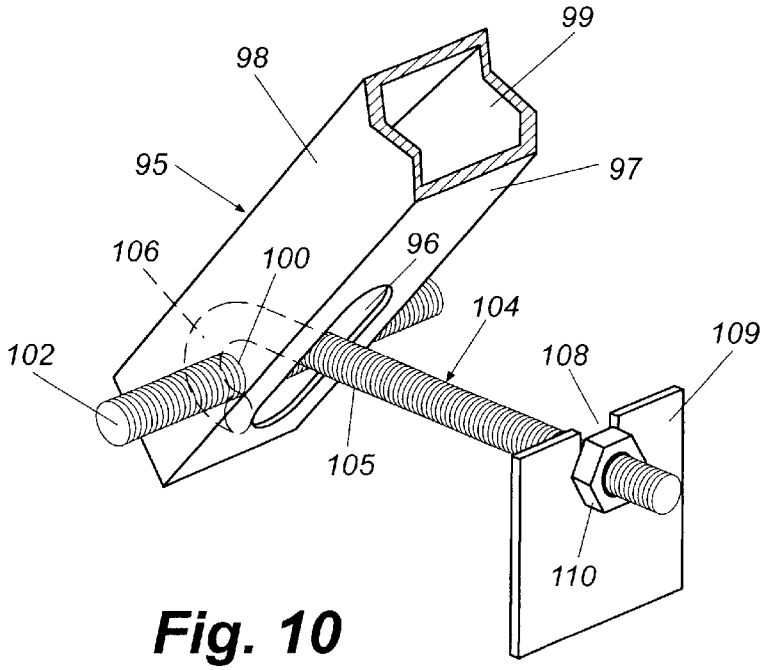
FIG. 10 is a perspective illustration of the lower end of the strut of FIG. 9, showing the travel screw inserted through the bottom opening of the strut.
Figure 12:
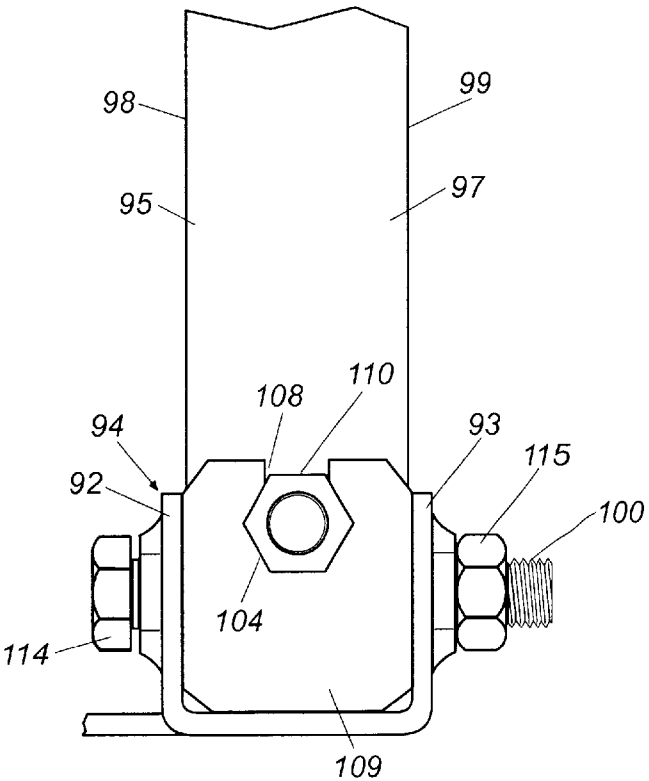
FIG. 12 is an end view of the support clevis and the lower end of the strut of FIGS. 9–11.
Figure 11:
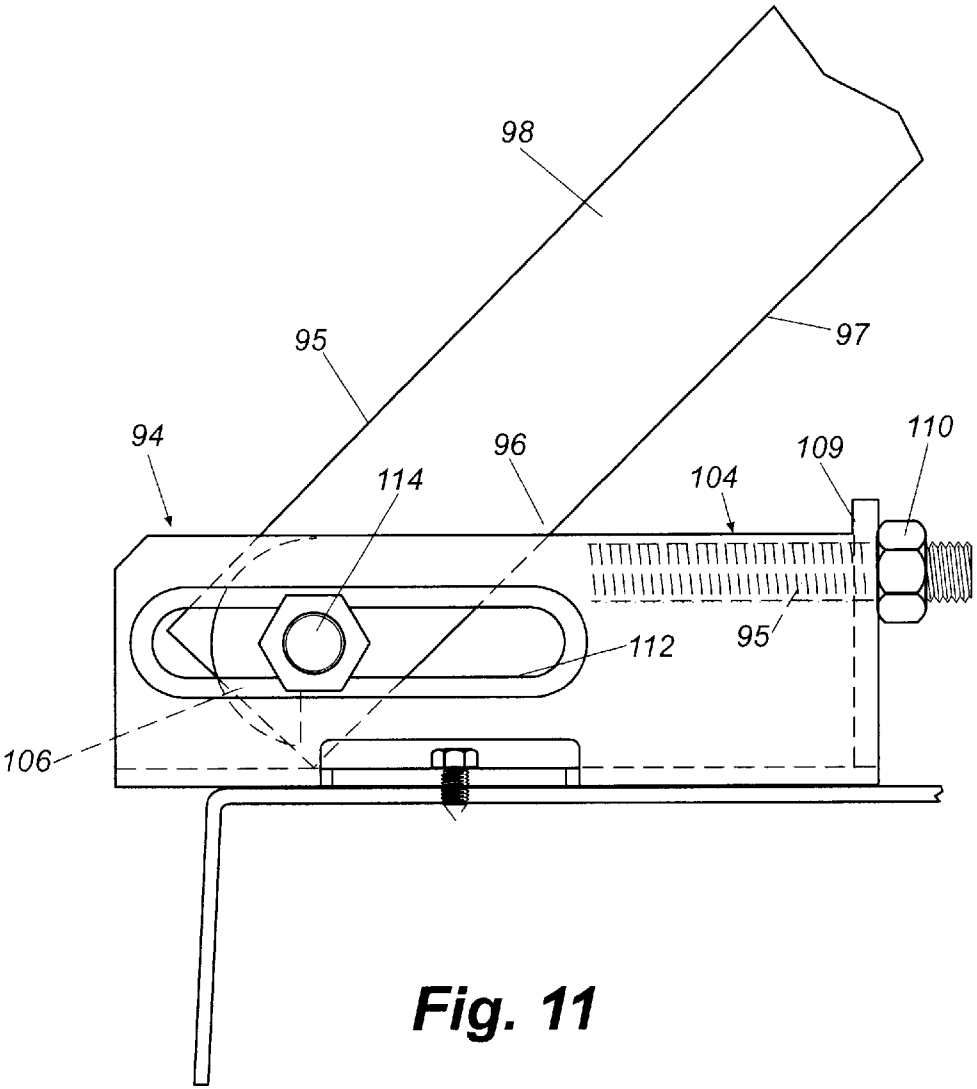
FIG. 11 is a side elevational view of the support clevis and lower end of the strut of FIGS. 9 and 10, showing the assembly mounted on the support platform.

As shown in FIG. 9, the opposite ends of laterally extending support screw 102 protrude through aligned slots 112 and 113, and clamp nuts 114 and 115 are threaded onto the ends of the support screw 102 (FIG. 2) so as to apply compressive frictional engagement against the side walls 92 and 93 of the support clevis 94, tending to lock the support screw 102 in a fixed position with respect to the support clevis 94.

The adjustable support system, including the adjustable piers, provides a means for adjusting the height at which the support joists 12 and 13 of the building are supported from the ground. Also, they provide a means for adjusting the load applied by the building to the struts. The expedient manner in which the adjustable piers can be mounted, and the flexibility of being able to locate the adjustable piers at any position along the length of the joists, provides the installer with the option to place the adjustable piers at the positions along the joists that are most likely to require additional support. For example, if heavy objects are to be placed in the building structure, such as kitchen or laundry appliances, an additional adjustable pier can be placed at that location. Also, the placement of the adjustable piers at the ends of the building structure assure that a proper load is borne at those positions. The adjustable piers also function to resist movement of the joists due to wind and seismic forces. The adjustable piers are capable of being adjusted at any time, so that if the building structure and/or piers settle, the adjustable piers can be adjusted to compensate for the settling of the structure.

Although preferred embodiments of the invention have been disclosed in detail herein, it will be obvious to those skilled in the art that variations and modifications of the disclosed embodiments can be made without departing from the spirit and scope of the invention as set forth in the following claims.

What is claimed is:

1. An adjustable pier for a premanufactured building having longitudinally extending parallel support joists positioned above the ground, said adjustable pier comprising:

a support platform for positioning beneath a joist of a building;

at least one strut having a platform end and a joist end;

a joist connector for connecting said joist end of the strut to a joist of a building;

a platform connector for connecting said platform end of said strut to said support platform so that the strut slopes upwardly from said support platform to said joist connector;

said platform connector including adjustment means for progressively moving said platform end of said strut with respect to said support platform;

whereby said adjustable pier can be positioned beneath a building and the strut progressively moved with respect to the support platform into increased compression between the platform and the joist of the building in response to said adjustment means.

2. The adjustable pier of claim 1, wherein said platform comprises sheet metal with a substantially flat body portion and opposed edges, said opposed edges being formed at an approximately right angle with respect to said body portion to form cleats for penetrating the ground beneath the support platform.

3. The adjustable pier of claim 2, wherein said platform connector includes a travel screw connected to said platform and movably mounted to said strut, and a nut mounted on said travel screw and adapted to move said strut along the length of said travel screw.

4. The adjustable pier of claim 1, wherein said cleats are oriented approximately normal to said strut.

5. The adjustable pier of claim 1, wherein said platform connector comprises a clevis mounted to said platform and said adjustment means comprises a travel screw movably supported in said clevis and a nut threaded on said travel screw.

6. The adjustable pier of claim 1, wherein said at least one strut comprises a pair of said struts mounted to said platform and sloped upwardly in opposite directions from said platform.

7. The adjustable pier of claim 6, wherein said struts are arranged in a configuration selected form "X" shape, "V" shape, and inverted "V" shape.

8. The adjustable pier of claim 1, wherein said strut is formed of telescopic parts adjustably connected together.

9. The adjustable pier of claim 3, and further including a torque wrench for adjusting said nut for applying a predetermined compression in said strut between said platform and said joist connector.

10. The adjustable pier of claim 1, and further including indicia on said platform connector for indicating the angle between said strut and said platform.

11. The adjustable pier of claim 10, wherein said indicia comprises scribe lines of said platform connector.

12. The adjustable pier of claim 1, and further including a lateral strut extending between said platform and the parallel joist, and means for adjusting the compression forces applied to said lateral strut.

13. The adjustable pier of claim 2, wherein said platform end of said strut is curved for extending vertically with respect to said support platform.

14. The adjustable pier of claim 1, wherein said platform end of said strut extends upright from said platform.

15. The adjustable pier of claim 1, wherein said connector means comprises adjustment means for moving said strut parallel to a joist of the building.

16. A support system for a premanufactured building having a support joist, comprising:

a support platform including cleats for engaging the ground beneath said platform;

a strut having a joist end and a platform end;

a joist connector for connecting said joist end of said strut to a joist of a building;

a platform connector for connecting said platform end of said strut to said support platform so that said strut extends at a slope upwardly from said support platform toward the joist of the building structure;

said platform connector including force adjustment means for progressively moving said platform end of said strut with respect to said support platform;

whereby the forces of compression applied to the strut between the support platform and the joist are progressively adjusted by progressively changing the position of the platform end of the strut with respect to the support platform.

17. The support system of claim 16, wherein said platform connector includes a clevis mounted to said support platform, and said force adjustment means includes a threaded travel screw mounted to said clevis, said strut mounted to said threaded travel screw, and a threaded nut engaging said threaded travel screw and said strut and adapted to move said platform end of said strut with respect to said support platform and substantially parallel to the joist of the building structure.

18. The support system of claim 16, wherein the premanufactured building structure includes a second joist parallel to said first mentioned joist, and further including a lateral strut at a extending at a slope between said support platform and said second joist, and a second force adjustment means adapted to move said second strut toward said second joist.

19. A support system for a premanufactured building having longitudinally extending parallel support joists, said support system comprising:

a plurality of static piers mounted in spaced relationship from one another on the ground adapted for positioning beneath the parallel joists of a premanufactured building for supporting the parallel joists from the ground;

a plurality of adjustable piers mounted on the ground between said static piers, said adjustable piers each including a support platform for engaging the ground, a pair of struts extending at oppositely upwardly sloped angles from said support platform;

said struts having opposed ends, including a platform end positioned adjacent said support platform and a joist end for placement adjacent the joist of the premanufactured building;

a joist connector mounted to said joist ends of said struts for connecting said struts to a joist of the premanufactured building;

a platform connector for connecting said platform ends of said struts to said support platform; and said platform connector including means for moving said platform end of each of said struts across said support platform and in an arc with respect to the joist of the premanufactured building to effectively change the compression load applied by the building to the struts.

20. The support system of claim 19, wherein said support platform includes cleats for penetrating the ground engaged by said platform.

21. The support system of claim 19, wherein said platform connector includes a clevis for each strut mounted to said support platform, a travel screw mounted to and extending along each clevis, said platform end of each of said struts mounted to said travel screw, and an adjustment nut engaging said travel screw adapted to move said strut along said travel screw.

22. An adjustable pier for a premanufactured building structure having a rectilinear horizontally extending support joist, said adjustable pier comprising:

a support platform for placement on the ground beneath a support joist;

a pair of struts extending at opposite upwardly sloped angles from said support platform for connection to ajoist of the building structure;

connector means for connecting said struts to the joist; and adjustment means for progressively adjusting the vertical load applied by the building structure on said pair of struts.

23. The support system of claim 22, wherein said adjustment means comprises a travel screw mounted to said support platform, said travel screw movably mounted to said support platform, and adjustment means for moving said strut along the length of said travel screw.

24. The support system of claim 22, wherein said adjustment means includes a clevis mounted to said support platform, a travel screw supported by said clevis and mounted to said strut, and an adjustment member arranged to move said strut with respect to said travel screw.

* * * * *